US008776885B2

(12) United States Patent
Holderman

(10) Patent No.: US 8,776,885 B2
(45) Date of Patent: Jul. 15, 2014

(54) SAND CONTROL DEVICE CLEANING SYSTEM

(75) Inventor: Luke W. Holderman, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/820,879

(22) PCT Filed: Apr. 25, 2012

(86) PCT No.: PCT/US2012/034956

§ 371 (c)(1),
(2), (4) Date: Mar. 5, 2013

(87) PCT Pub. No.: WO2013/162545

PCT Pub. Date: Oct. 31, 2013

(65) Prior Publication Data

US 2013/0284421 A1 Oct. 31, 2013

(51) Int. Cl.

| | |
|---|---|
| ***E21B 37/08*** | (2006.01) |
| ***E21B 37/00*** | (2006.01) |
| ***E21B 27/00*** | (2006.01) |
| ***E21B 43/02*** | (2006.01) |

(52) U.S. Cl.
USPC ..... 166/311; 166/164; 166/56

(58) Field of Classification Search
USPC ..... 166/56, 164, 227, 236, 311, 376, 169
See application file for complete search history.

(56) References Cited

U.S. PATENT DOCUMENTS

| | | | | |
|---|---|---|---|---|
| 4,562,854 | A * | 1/1986 | Pringle et al. | 137/155 |
| 5,355,956 | A | 10/1994 | Restarick | |
| 6,550,551 | B2 * | 4/2003 | Brunnert et al. | 175/61 |
| 7,543,648 | B2 | 6/2009 | Hill et al. | |
| 7,546,878 | B2 * | 6/2009 | Prado et al. | 166/311 |
| 7,665,517 | B2 | 2/2010 | Nguyen et al. | |
| 7,832,476 | B2 * | 11/2010 | Schafer et al. | 166/278 |
| 7,870,899 | B2 * | 1/2011 | Wilson | 166/244.1 |
| 8,056,637 | B2 * | 11/2011 | Larnach | 166/375 |
| 8,342,241 | B2 * | 1/2013 | Hartshorne et al. | 166/252.6 |
| 2008/0017382 | A1 * | 1/2008 | Harris et al. | 166/307 |
| 2008/0142225 | A1 * | 6/2008 | Prado et al. | 166/311 |
| 2008/0156481 | A1 | 7/2008 | Paulus Maria Heijnen | |
| 2009/0008092 | A1 * | 1/2009 | Haeberle et al. | 166/278 |
| 2010/0155064 | A1 * | 6/2010 | Nutley et al. | 166/278 |
| 2011/0083860 | A1 | 4/2011 | Gano et al. | |
| 2011/0094754 | A1 * | 4/2011 | Smart | 166/381 |

OTHER PUBLICATIONS

International Patent Application No. PCT/US2012/034956, "International Search Report and Written Opinion", mailed Dec. 14, 2012 (9 pages).

* cited by examiner

*Primary Examiner* — Brad Harcourt
*Assistant Examiner* — Michael Wills, III
(74) *Attorney, Agent, or Firm* — Kilpatrick Townsend & Stockton LLP

(57) ABSTRACT

Certain aspects and embodiments of the present invention are directed a sand control device cleaning system that can be disposed in a wellbore through a fluid-producing formation. The sand control device cleaning system can include a housing and a fluid communication structure. The housing can be coupled to a section of a tubing string of a well system. A portion of the housing or a container disposed within the housing can store a dissolving material. A dissolving fluid that can dissolve or otherwise remove particulate material can be formed from the dissolving material. The fluid communication structure can communicate the dissolving fluid from the housing to a sand control device coupled to the section of the tubing string.

22 Claims, 6 Drawing Sheets

SAND CONTROL DEVICE CLEANING SYSTEM

CROSS-REFERENCE TO RELATED APPLICATIONS

This application is a U.S. national phase patent application under 35 U.S.C. 371 of International Patent Application No. PCT/US2012/034956, titled "Sand Control Device Cleaning System" and filed Apr. 25, 2012, the entirety of which is incorporated herein by reference.

TECHNICAL FIELD OF THE INVENTION

The present invention relates generally to sand control devices for a well system through a subterranean formation and, more particularly (although not necessarily exclusively), to sand control device cleaning systems that can remove particulate material from sand control devices in producing wells.

BACKGROUND

Particulate materials, such as sand, may be produced during the production of hydrocarbons from a well system traversing a subterranean formation. The production of sand can restrict productivity, erode components of the well system, impede wellbore access, interfere with the operation of downhole equipment, and present disposal difficulties. A well system can include devices and procedures for sand control. Sand control can include preventing sand, silt, or other particulate material from entering a wellbore or near-wellbore area of a well system.

An example of a sand control device is a sand screen coupled to sections of a tubing string of a well system. A sand screen can filter particulate material from production fluid by allowing the production fluid to flow through the sand screen and by preventing particulate material in the production fluid from passing through the sand screen. One example of a sand screen is a wire wrapped helically around a perforated piece of pipe. The helically wrapped wire is spaced and/or gauged based on the average size of the particle to be filtered. Another example of a sand screen is a mesh filter. A mesh filter can include a group of fibers or other materials that are woven perpendicularly to another group of fibers or other materials, thereby forming pores allowing the flow of fluid through the mesh filter.

Filtering of particulate material can cause a sand screen or other sand control device to become obstructed by filtered particulate material and other debris, thereby reducing or preventing the flow of production fluid through the sand screen. One solution to reduce obstruction of a sand screen can include inserting a component such as a wash pipe into a production tubing to communicate a cleaning material, such as an acid, to the sand control device. Such a cleaning material can dissolve particulate material and other debris obstructing a sand control device. Such solutions can present a disadvantage by increasing the number of components to be deployed and operated within a well system.

It is therefore desirable to remove particulate material and other debris obstructing a sand control device without inserting additional components into the wellbore.

SUMMARY

In some embodiments, a sand control device cleaning system is provided that can be disposed in a wellbore through a fluid-producing formation. The sand control device cleaning system can include a housing and a fluid communication structure. The housing can be coupled to a section of a tubing string of a well system adjacent to a sand control device and can store a dissolving material. In some embodiments, the sand control device cleaning system can include a container disposed within the housing and storing the dissolving material. The fluid communication structure can communicate a dissolving fluid to a sand control device coupled to the section of the tubing string. The dissolving fluid can be formed from the dissolving material. The dissolving fluid can dissolve particulate material filtered by the sand control device.

These illustrative aspects and features are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
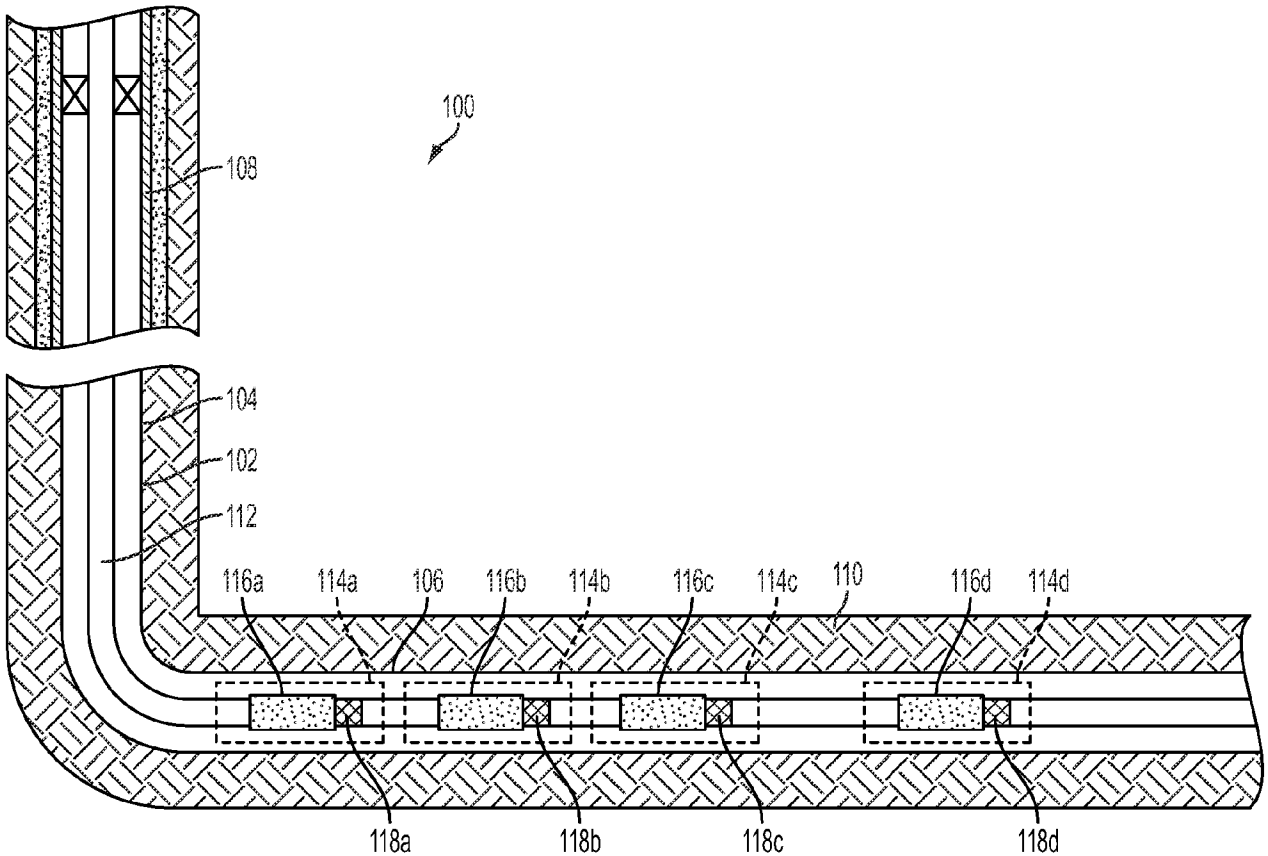
FIG. 1 is a schematic illustration of a well system having a sand control device cleaning system according to one embodiment of the present invention.

Certain aspects and embodiments of the present invention are directed to a sand control device cleaning system that can be disposed in a wellbore through a fluid-producing formation. The sand control device can be coupled to a section of a tubing string configured to be disposed in a wellbore through a fluid-producing formation. The sand control device cleaning system can be disposed in the wellbore adjacent to a sand control device coupled to the section of the tubing string, such as a sand screen. The sand control device cleaning system can include a source of a dissolving material, such as a portion of the housing or a container disposed within the housing storing an acid or a chemical that can react with fluids in the wellbore to generate an acid. Pressure can be applied to the container to cause the dissolving material to exit the container. Acid can be generated as a result of the dissolving material exiting the container. The acid can enter an annular space between the sand control device and the formation. The acid can contact particulate material or other debris on the sand screen, thereby dissolving the particulate material or other debris obstructing the flow of fluid through the sand screen.

The sand control device cleaning system can include a housing, a container, and a fluid communication structure. The housing can be coupled to a section of a tubing string of a well system. The housing can be adapted to circumferentially surround the section of the tubing string. The housing can be coupled to the tubing string via any suitable means. In some embodiments, the housing can welded to a section of the tubing string. In other embodiments, the housing can coupled to the tubing string via clamps, O-rings, or fasteners such as screws or bolts. The housing can include one or more openings allowing fluid to flow from the formation to an inner diameter of the tubing string, and vice versa.

The housing can be manufactured from any suitable material. Examples of suitable material can include (but are not limited to) steel or other metals. The housing can be a unitary structure or a group of structures coupled to one another. For example, a housing including a group of structures coupled to one another can provide a group of compartments in which different components of the sand control device screening system can be disposed and/or isolated from one another.

The container can be disposed within the housing. The container can have a dissolving material stored therein. In some embodiments, the dissolving material can be a dissolving fluid that can dissolve, disintegrate, or otherwise remove particulate material. In other embodiments, the dissolving material can react with fluids in the wellbore to generate a dissolving fluid that can dissolve, disintegrate, or otherwise remove particulate material. The fluid communication structure can communicate the dissolving fluid to an annular space between a sand control device coupled to the section of the tubing string and the formation through which the tubing string is disposed.

The sand control device cleaning system can also include a piston disposed within the housing. The piston can be disposed in the housing adjacent to the container. Pressure from a pressure source within an inner diameter of the tubing string can be communicated to the piston. For example, fluid can be injected in a reverse-flow direction from a rig at the surface of the wellbore through the inner diameter of the tubing string to the subterranean formation. Injecting fluid in a reverse flow direction can cause pressure to be communicated from the inner diameter of the tubing string to the piston. Communicating pressure to the piston can apply force to the piston. Applying force to the piston can cause the piston to apply a force to the container, thereby causing the container to open. In some embodiments, a protrusion, such as a spike or pin, can be coupled to or integral with the piston. Applying force to the piston can cause the protrusion to puncture the container. The force applied to the container by the piston can compress the container, thereby causing the dissolving material to exit the container.

In some embodiments, the dissolving material can include an acid, such as a hydrochloric or other acid. In other embodiments, the dissolving material can be any chemical material that can be combined with hydrocarbons to generate an acid. In other embodiments, the dissolving material can be any chemical material that can be combined with water to generate an acid.

The container can be any container suitable for storing the dissolving material. For example, a glass or plastic container can be used as a container for storing a dissolving material that is a hydrochloric acid. In some embodiments, the container can be formed from a rigid material, such as (but not limited to) glass or metal. In other embodiments, the container can be formed from a flexible material, such as (but not limited to) plastic or rubber. The container can be adapted to circumferentially surround the section of the tubing string.

The sand control device cleaning system can also include a valve assembly disposed within the housing. The valve assembly can include a check valve allowing fluid to flow in a direction from the fluid-producing formation to an inner diameter of the tubing string. In some embodiments, the valve assembly can include a collet assembly. The valve assembly can be configured to prevent fluid flow in response to pressure being communicated from a pressure source within an inner diameter of the tubing string to a check valve of the valve assembly. The valve assembly can thereby prevent fluid flowing between the inner diameter of the tubing string and the fluid-producing formation. Preventing fluid flowing between the inner diameter of the tubing string and the fluid-producing formation can prevent the dissolving material from exiting the annular space between the tubing string and the fluid-producing formation. Preventing the dissolving material from exiting the annular space between the tubing string and the fluid-producing formation can allow the dissolving material to remain in contact with the sand control device, thereby dissolving or otherwise removing particulate material obstructing the flow of fluid through the sand control device.

In some embodiments, the valve assembly can be disposed within a first compartment of the housing and the piston can be disposed within a second compartment of the housing. Fluid can flow through first compartment of the housing from the fluid-producing formation to an inner diameter of the tubing string. The housing can be adapted to allow fluid to flow from the inner diameter of the tubing string to the second compartment of the housing. Injecting fluid in a reverse flow direction can cause the valve assembly to prevent fluid from flowing between the fluid-producing formation and the inner diameter of the tubing string. Preventing fluid from flowing between the fluid-producing formation and the inner diameter of the tubing string can cause pressure to be communicated from the inner diameter of the tubing string to the piston disposed in the second compartment of the housing. The pressure being communicated to the piston can cause the piston to apply force to the container, thereby causing the container to open and causing the dissolving material to exit the container. The dissolving material exiting the container can cause a dissolving fluid to be communicated to the sand control device.

These illustrative examples are given to introduce the reader to the general subject matter discussed here and are not intended to limit the scope of the disclosed concepts. The following sections describe various additional embodiments and examples with reference to the drawings in which like numerals indicate like elements, and directional descriptions are used to describe the illustrative embodiments. The following sections use directional descriptions such as "above," "below," "upper," "lower," "upward," "downward," "left," "right," "uphole," "downhole," etc. in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative embodiments, the numerals and directional descriptions included in the following sections should not be used to limit the present invention.

FIG. 1 schematically depicts a well system 100 having a tubing string 112 with sand control device cleaning systems 118*a-d* according to certain embodiments of the present invention. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

The tubing string 112 within wellbore 102 extends from the surface to the subterranean formation 110. The tubing string can include one or more tubing sections 114*a-d*. The tubing string 112 can provide a conduit for formation fluids, such as production fluids produced from the subterranean formation 110, to travel from the substantially horizontal section 106 to the surface. Pressure from a bore in a subterranean formation can cause formation fluids, including production fluids such as gas or petroleum, to flow to the surface.

The well system 100 can also include one or more sand control devices 116*a-d*. Each of the sand control devices 116*a-d* can be coupled to a respective tubing section 114*a-d* of the tubing string 112 at a horizontal section 106. The sand control devices 116*a-d* can filter particulate materials of a predetermined size from the production fluid of the subterranean formation 110 as the production fluid flows into the tubing sections 114*a-d*.

The well system 100 can also include one or more sand control device cleaning systems 118*a-d*. Each of the sand control device cleaning systems 118*a-d* can be coupled to a respective tubing section 114*a-d* at a position adjacent to a respective sand control device 116*a-d*. The sand control device cleaning systems 118*a-d* can remove or reduce particulate materials or other debris obstructing the flow of production fluid through the sand control devices 116*a-d* into the tubing sections 114*a-d*.

Although FIG. 1 depicts the sand control device cleaning systems 118*a-d* positioned in the substantially horizontal section 106, a sand control device cleaning system can be located, additionally or alternatively, in the substantially vertical section 104. In some embodiments, sand control device cleaning systems can be disposed in simpler wellbores, such as wellbores having only a substantially vertical section. Sand control device cleaning systems can be disposed in openhole environments, such as is depicted in FIG. 1, or in cased wells. Sand control device cleaning systems can be disposed in well systems having other configurations including vertical wells, deviated wells, slanted wells, multilateral wells, etc.

Although FIG. 1 depicts four sand control device cleaning systems 118*a-d* positioned in the tubing string 112, any number of sand control device cleaning systems can be used.

Figure 2:
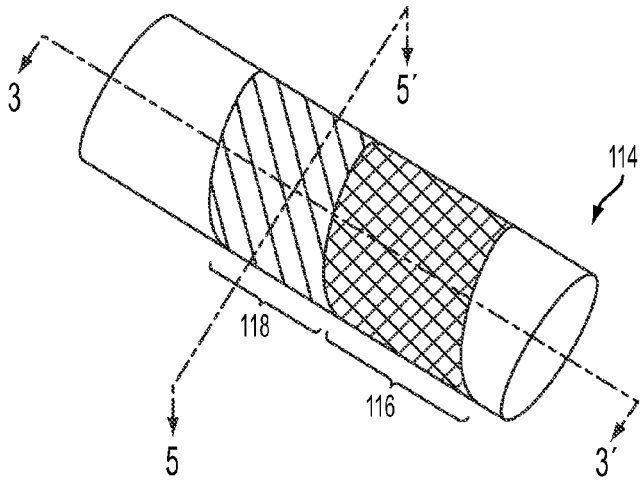
FIG. 2 is a perspective view of a section of a tubing string having a sand control device cleaning system according to one embodiment of the present invention.
Figure 3:
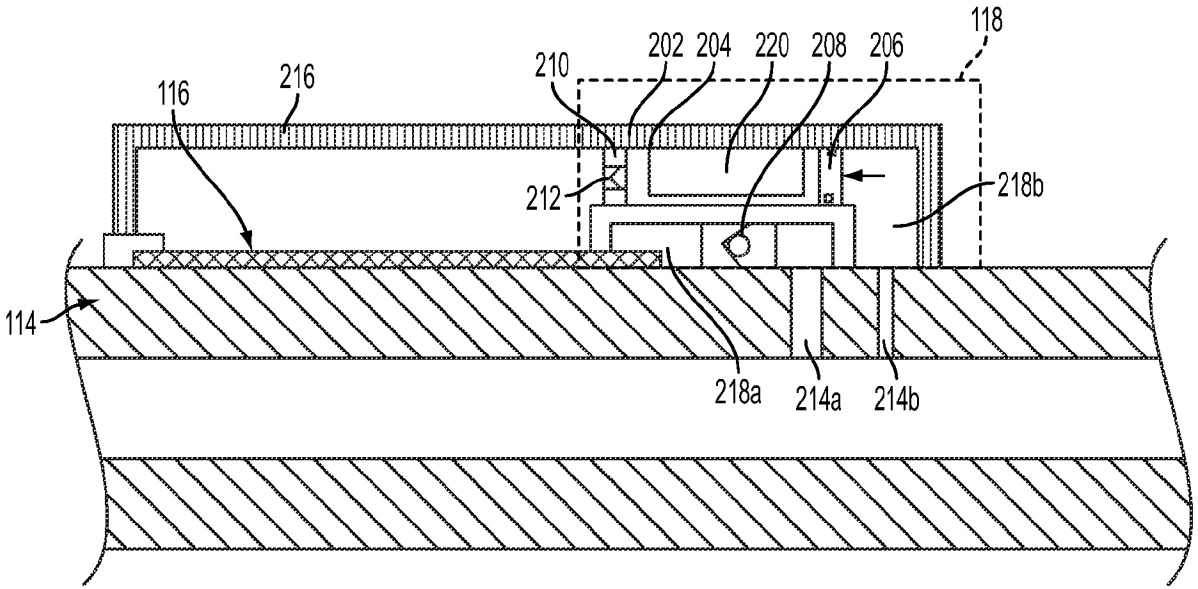
FIG. 3 is a longitudinal cross-sectional view of a section of a tubing string having a sand control device cleaning system according to one embodiment of the present invention.
Figure 4:
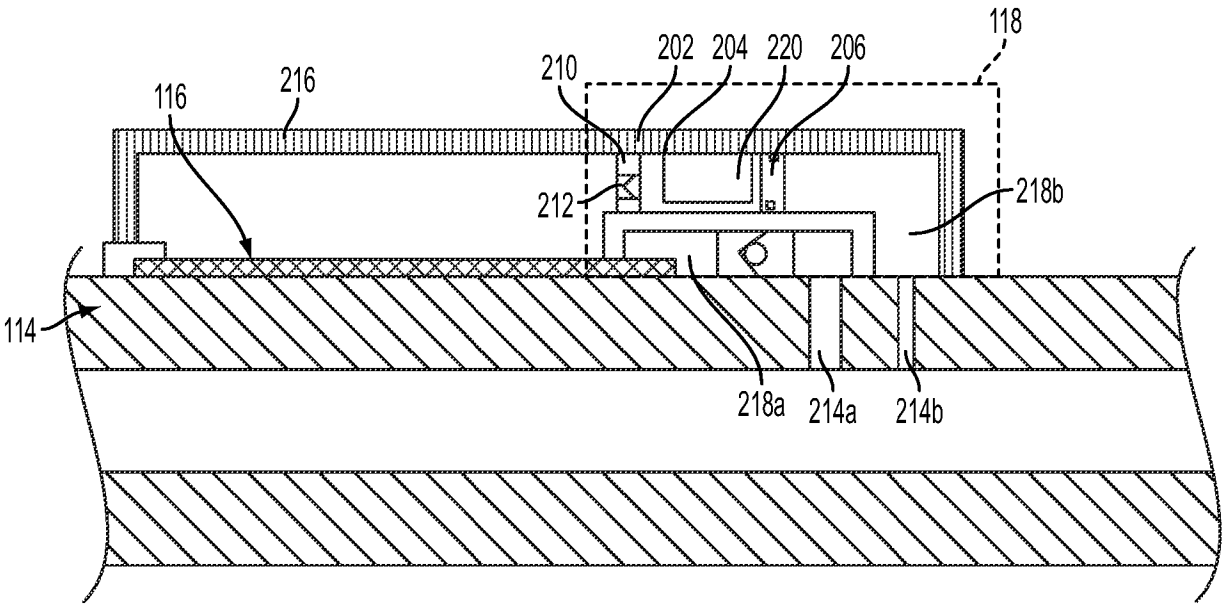
FIG. 4 is a longitudinal cross-sectional view of a section of a tubing string having a sand control device cleaning system with a piston applying force to a source of dissolving material according to one embodiment of the present invention.
Figure 5:
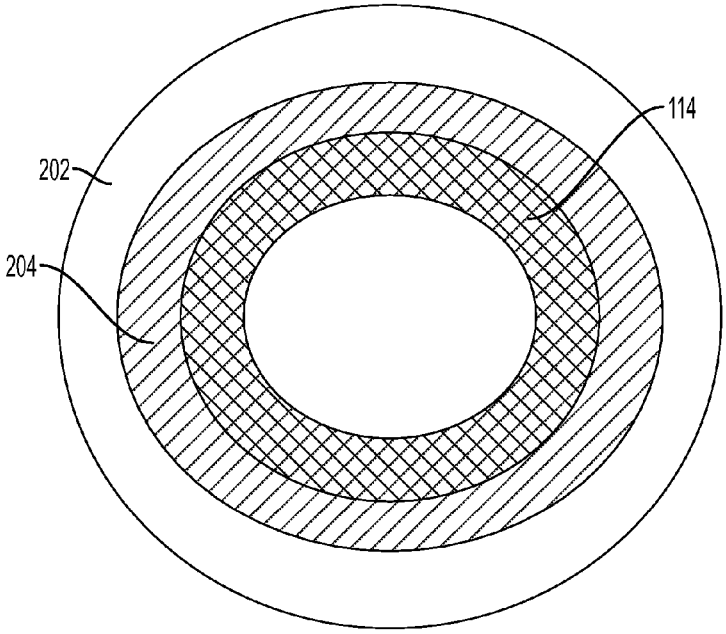
FIG. 5 is a lateral cross-sectional view of a section of a tubing string having a sand control device cleaning system according to one embodiment of the present invention.

FIGS. 2-5 depict an example of a sand control device cleaning system 118 coupled to a tubing section 114 of a tubing string 112. FIG. 2 is a perspective view of a sand control device cleaning system 118 coupled to the tubing section 114. FIGS. 3 and 4 depict longitudinal cross-sectional views of the sand control device cleaning system 118 coupled to the tubing section 114 taken along the line 3-3' of FIG. 2. FIG. 5 depicts a lateral cross-sectional view of the tubing section 114 having the sand control device cleaning system 118 taken along the line 5-5' of FIG. 2.

The sand control device cleaning system 118 can include a housing 202, a container 204, a piston 206, a valve assembly 208, and a fluid communication structure 210. The tubing section 114 can include ports 214*a*, 214*b* through the body of the tubing section 114. The ports 214*a*, 214*b* can allow fluid to flow between housing 202 and an inner diameter of the tubing section 114. The sand control device cleaning system 118 can be coupled to the tubing section 114 adjacent to the sand control device 116. The sand control device 116 can include a shroud 216. Production fluid from the subterranean formation 110 can flow through the sand control device 116 via the housing 202 and the port 214*a* to the inner diameter of the tubing section 114.

The housing 202 can be manufactured from any suitable material, such as (but not limited to) steel or other metals. The housing 202 can be coupled to the tubing section 114 via any suitable means. In some embodiments, the housing 202 can welded to the tubing section 114. In other embodiments, the housing 202 can coupled to the tubing section 114 via clamps, O-rings, or fasteners such as screws or bolts.

As depicted in FIG. 4, the container 204 disposed within the housing 202 can circumferentially surround the tubing section 114. The housing 202 can circumferentially surround the container 204 and the tubing section 114.

Although FIG. 4 depicts the container 204 and the housing 202 circumferentially surrounding the tubing section 114, other implementations are possible. In some embodiments, either or both of the housing 202 and the container 204 can be adapted such that the housing 202 and/or the container 204 does not circumferentially surround the tubing section 114.

The housing 202 can include compartments 218*a*, 218*b*. In some embodiments, the housing 202 can be a unitary structure having the compartments 218*a*, 218*b*. In other embodiments, the compartments 218*a*, 218*b* can be separate structures coupled together to form the housing 202.

Fluid can flow between the subterranean formation 110 and an inner diameter of the tubing section 114 via the compartment 218*a* and a port 214*a* in the body of the tubing section 114. Fluid can flow from the inner diameter of the tubing section 114 into the compartment 218*b* via a port 214*b* in the body of the tubing section 114. Injecting fluid in a reverse flow direction can cause pressure from the inner diameter of the tubing section 114 to be communicated to the compartment 218*b* via the port 214*b*.

The container 204 can have dissolving material 220 stored within an inner volume of the container 204. In some embodiments, the dissolving material 220 can be a dissolving fluid. In other embodiments, the dissolving material 220 can react with fluids in the wellbore 102, such as water or hydrocarbons, to generate a dissolving fluid. The dissolving fluid can be any material suitable for dissolving, disintegrating, or otherwise removing particulate material or other debris obstructing the sand control device 116. The dissolving fluid can remove particulate material or other debris from the sand control device 116 without damaging components of the sand control device 116 or other components of the well system 100. In some embodiments, the dissolving fluid can be an acid, such as a hydrochloric or other acid.

The container 204 can be any container suitable for storing the dissolving material 220. For example, a glass or plastic container can be used as a container for storing a dissolving material 220 that is a hydrochloric acid. The container 204 can be formed from a rigid material, such as (but not limited to) glass or metal, or from a flexible material, such as (but not limited to) plastic or rubber. In some embodiments, the container 204 can be retained with the housing 202 using a retaining disc 212. The retaining disc 212 can be a thin diaphragm of metal that can be ruptured by a force exerted by a piston 206.

Although FIGS. 2 and 4 include the container 204 disposed in the housing 202, other implementations are possible. In some embodiments, the container 204 can be omitted. A portion of the housing 202 can be configured for storing the dissolving material 220.

The valve assembly 208 can be disposed in compartment 218*a* of the housing 202. The valve assembly 208 can include a check valve. The valve assembly 208 can allow production fluid to flow from the subterranean formation 110 to an inner diameter of the tubing section 114. Fluid injected in a reverse-flow direction through the tubing section 114 can cause the valve assembly to close, thereby preventing fluid from flowing between the inner diameter of the tubing section 114 and the subterranean formation 110. Preventing fluid from flowing between the inner diameter of the tubing section 114 and the subterranean formation 110 can prevent pressure from the inner diameter of the tubing section 114 from being communicated to the exterior of the tubing section 114, thereby causing the pressure to be communicated to the compartment 118*b*.

The piston 206 can be disposed in the compartment 218*b* of the housing 202. The piston 206 can transfer force to the container 204. The force can be generated from the pressure communicated to the compartment 118*b*. For example, pressure caused by fluid being injected in a reverse flow direction through the tubing section 114 can be communicated to the piston 206, as depicted by the leftward arrow in FIG. 3. The pressure communicated to the piston 206 can cause force to be applied to the container 204. For example, as depicted in FIG. 4, the piston 206 can apply force to the container 204, thereby rupturing the retaining disc 212 retaining the container 204 within the housing and causing the container 204 to open. Opening the container 204 can cause the dissolving material 220 stored within the container 204 to exit the container and enter the annular space between the sand screen 116 and the formation 110 via the fluid communication structure 210. The dissolving material 220 can cause a dissolving fluid to contact particulate mater or other debris on the sand control device 116, thereby dissolving, disintegrating, or otherwise removing or reducing the particulate material.

In some embodiments, the fluid communication structure 210 can be a portion of the housing shaped to provide a conduit via which the dissolving material 220 can be communicated to the annular space. In other embodiments, the fluid communication structure 210 can be a separate structure or device disposed within the housing 202, such as, for example, a valve or tube.

The pressure communicated to the piston 206 can also cause the valve assembly 208 to close, thereby preventing fluid from flowing between the inner diameter of the tubing section 114 and the subterranean formation 110. Preventing fluid from flowing between the inner diameter of the tubing section 114 and the subterranean formation 110 can prevent the dissolving material from exiting the annular space between the sand control device 116 and the subterranean formation 110. Preventing the dissolving material from exiting the annular space can allow the dissolving material to remain in contact with the sand control device 116, thereby dissolving or otherwise reducing the amount of particulate material obstructing the flow of fluid through the sand control device 116.

The shroud 216 can circumferentially surround the sand control device 116. The shroud 216 can retain the dissolving material in a position contacting the sand control device 116. Although FIGS. 3-4 depict the shroud 216 circumferentially surrounding the sand control device 116, other implementations are possible. In some embodiments, the shroud 216 can be omitted.

Figure 6:
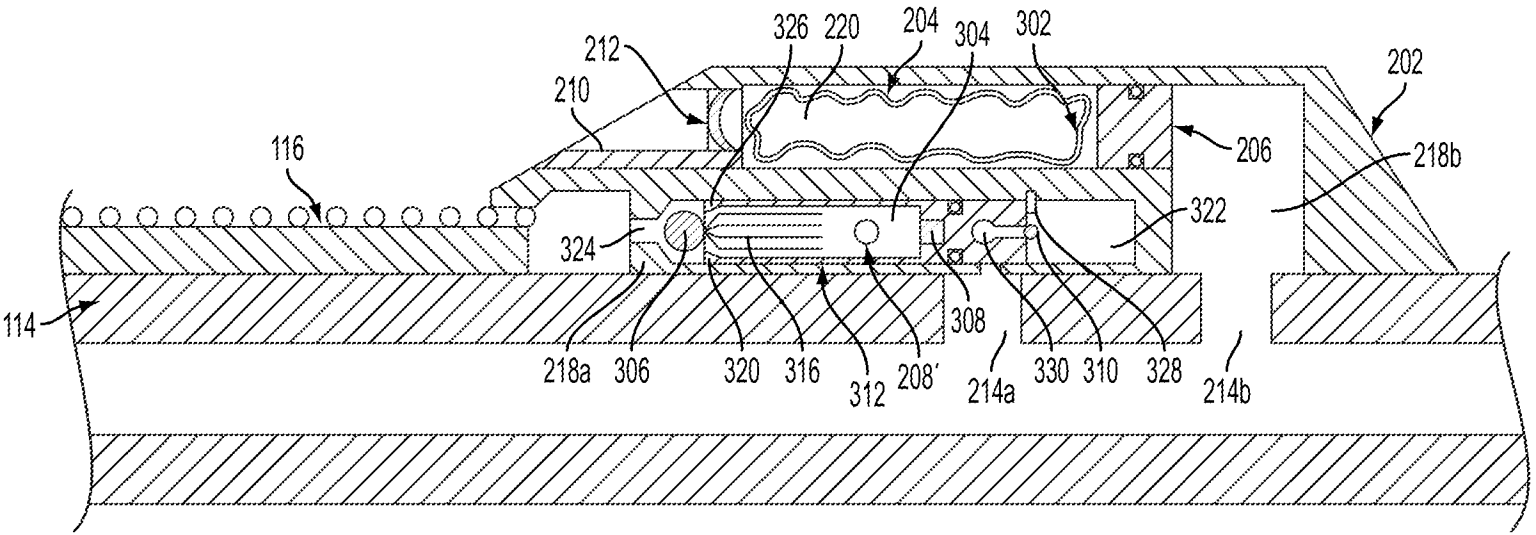
FIG. 6 is a longitudinal cross-sectional view of a section of a tubing string having a sand control device cleaning system with a valve assembly that includes a collet assembly according to one embodiment of the present invention.

FIG. 6 depicts a longitudinal cross-sectional view of the tubing section 114 having sand control device cleaning system 118' with a valve assembly 208'.

The piston 206 of the sand control device cleaning system 118' can include a protrusion 302, such as a pin or spike. The protrusion 302 can be coupled to or integral with the piston 206. The protrusion 302 can puncture the container 204.

The valve assembly 208' can include a piston assembly 304, a valve plug 306, a ball retainer 308 and a retainer pin 310. The piston assembly 304 can include a piston body 312 having a plurality of collet fingers 316 forming a collet assembly 318.

Each collet finger 316 can include a lip 320. The collet fingers 316 of collet assembly 318 can be radially and outwardly constrained in a first operating position of valve assembly 208' to prevent entry of valve plug 306 within piston body 312 and radially and outwardly unconstrained in a second operating position of valve assembly 208' to allow entry and retention of valve plug 306 within piston body 312.

Fluid injected in a reverse flow direction can cause the valve plug 306 to move within an axial opening 322 against a seat 324 of the valve assembly. The valve plug 306 can create a seal within seat 324 of valve assembly 208', thereby preventing the flow of fluid from the inner diameter of the tubing section 114 to the exterior of the tubing section 114. Fluid flowing from the subterranean formation 110 can cause the valve plug 306 to move within the axial opening 322 against the lips 320. A radially reduced inner diameter portion 326 of axial opening 322 can be sized to receive collet fingers 316, thereby causing the collet fingers 316 to be radially outwardly constrained to prevent entry of valve plug 306 within piston body 312. The valve plug 306 can be a spherical blocking member, as depicted in FIG. 6. In other embodiments, the valve plugs 306 can have alternate shapes such as (but not limited to) cylindrical configurations, substantially cylindrical configurations or other configurations.

The piston assembly 304 can be retained by a retaining pin 328 at a first position within the axial opening 322 of the valve assembly 208'. Fluid injected in a reverse flow direction can cause sufficient pressure to be communicated to the piston assembly 304 such that the retaining pin 328 is sheared. Shearing the retaining pin 328 can allow the piston assembly 304 to move to a second position within the axial opening 322 of the valve assembly 208' such that an inner section 330 of the piston assembly 304 can contact the retainer pin 310. Contacting the retainer pin 310 can retain the piston assembly 304 at the second position within the axial opening 322 of the valve assembly 208'. The piston assembly 304 can be moved to the second position within the axial opening 322 by force applied to the piston assembly 304 by production fluid flowing through the housing 202. Retaining the piston assembly 304 at the second position can allow radial outward movement of the collet fingers 316 such that the valve plug 306 can move through the piston body 312. The valve plug 306 can move through the piston body 312 and contact a ball retainer 308, thereby disabling the valve assembly 208'.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

The invention claimed is:

1. A sand control device cleaning system comprising:

a housing configured to be coupled to a section of a tubing string disposed in a wellbore through a fluid-producing formation and configured for storing a dissolving material;

a piston disposed within the housing, wherein the piston is configured to cause the dissolving material to exit the housing in response to pressure being communicated to the piston;

a fluid communication structure configured to communicate a dissolving fluid formed from the dissolving material to a sand control device coupled to the section of the tubing string, wherein the dissolving fluid is adapted for dissolving particulate material filtered by the sand control device; and a valve assembly disposed within the housing, wherein the valve assembly is configured to prevent fluid from flowing between the fluid-producing formation and an inner diameter of the tubing string in response to pressure being communicated from the inner diameter of the tubing string to the valve assembly.

2. The sand control device cleaning system of claim 1, wherein the housing is adapted to circumferentially surround the section of the tubing string.

3. The sand control device cleaning system of claim 1, wherein the fluid communication structure comprises a valve disposed within the housing.

4. The sand control device cleaning system of claim 1, wherein the fluid communication structure comprises a portion of the housing configured to provide a conduit configured to communicate the dissolving material.

5. The sand control device cleaning system of claim 1, further comprising a container disposed within the housing, the container configured for storing the dissolving material.

6. The sand control device cleaning system of claim 5, further comprising a protrusion coupled to the piston, wherein the piston is further configured to cause the container to open by the protrusion puncturing the container.

7. The sand control device cleaning system of claim 5, further comprising a protrusion integral with the piston, wherein the piston is further configured to cause the container to open by the protrusion puncturing the container.

8. The sand control device cleaning system of claim 1, wherein the housing comprises:

a first compartment having the valve assembly disposed therein, the first compartment adapted to allow fluid to flow between the fluid-producing formation and the inner diameter of the tubing string; and a second compartment having a piston disposed therein, the second compartment adapted to communicate pressure from the inner diameter of the tubing string to the piston in response to the valve assembly preventing fluid from flowing between the fluid-producing formation and the inner diameter of the tubing string;

wherein the piston is configured to cause the container to open in response to the pressure being communicated to the piston.

9. The sand control device cleaning system of claim 8, wherein the valve assembly comprises a valve plug, a ball retainer and a piston body having a collet assembly configured to disable operation of the valve assembly.

10. The sand control device cleaning system of claim 1, wherein the dissolving material comprises a chemical adapted for being combined with a hydrocarbon to form the dissolving fluid, wherein the dissolving fluid comprises an acid.

11. The sand control device cleaning system of claim 1, wherein the dissolving material comprises a chemical adapted for being combined with water to form the dissolving fluid, wherein the dissolving fluid comprises an acid.

12. A production tubing system comprising:

a section of a tubing string configured to be disposed in a wellbore through a fluid-producing formation; and a sand control device cleaning system coupled to the section of the tubing string, the sand control device cleaning system adjacent to a sand control device coupled to the section of the tubing string, the sand control device cleaning system comprising:

a valve assembly;

a housing configured to be coupled to the section of the tubing string, the housing comprising a compartment having a piston disposed therein and adjacent to a container, the compartment adapted to communicate pressure from an inner diameter of the tubing string to the piston in response to the valve assembly preventing fluid from flowing between the fluid-producing formation and the inner diameter of the tubing string;

the container disposed within the housing, the container configured for storing a dissolving material; and a fluid communication structure configured to communicate a dissolving fluid formed from the dissolving material to the sand control device coupled to the section of the tubing string, wherein the dissolving fluid is adapted for dissolving particulate material filtered by the sand control device.

13. The production tubing system of claim 12, wherein the housing is adapted to circumferentially surround the section of the tubing string and wherein the container is adapted to circumferentially surround the section of the tubing string.

14. The production tubing system of claim 12, wherein the housing is welded to the section of the tubing string.

15. The production tubing system of claim 12, wherein the housing is coupled to the section of the tubing string via one or more clamps.

16. The production tubing system of claim 12, further comprising a piston disposed within the housing, wherein the piston is configured to cause the dissolving material to exit the container in response to pressure being communicated to the piston.

17. The production tubing system of claim 16, further comprising a protrusion coupled to the piston, wherein the piston is further configured to cause the container to open by the protrusion puncturing the container.

18. The production tubing system of claim 16, further comprising a protrusion integral with the piston, wherein the piston is further configured to cause the container to open by the protrusion puncturing the container.

19. The production tubing system of claim 12, wherein the valve assembly is disposed within the housing, wherein the valve assembly is configured to prevent fluid from flowing between the fluid-producing formation and an inner diameter of the tubing string in response to pressure being communicated from the inner diameter of the tubing string to the valve assembly.

20. The production tubing system of claim 19, wherein the housing comprises:

an additional compartment having the valve assembly disposed therein, the first compartment adapted to allow fluid to flow between the fluid-producing formation and the inner diameter of the tubing string wherein the piston is configured to cause the container to open in response to the pressure being communicated to the piston.

21. The production tubing system of claim 12, further comprising a shroud circumferentially surrounding the sand control device, wherein the shroud is adapted to retain the dissolving material in a position contacting the sand control device.

22. A sand control device cleaning system comprising:

a housing configured to be coupled to a section of a tubing string disposed in a wellbore through a fluid-producing formation;

a container disposed within the housing, the container configured for storing a dissolving material;

a fluid communication structure configured to communicate a dissolving fluid formed from the dissolving material to a sand control device coupled to the section of the tubing string, wherein the dissolving fluid is adapted for dissolving particulate material filtered by the sand control device;

a valve assembly disposed within a first compartment of the housing, the first compartment adapted to allow fluid to flow between the fluid-producing formation and an inner diameter of the tubing string, wherein the valve assembly is configured to prevent fluid from flowing between the fluid-producing formation and the inner diameter of the tubing string in response to pressure being communicated from the inner diameter of the tubing string to the valve assembly; and a piston disposed within a second compartment of the housing, the second compartment adapted to communicate pressure from the inner diameter of the tubing string to the piston in response to the valve assembly preventing fluid from flowing between the fluid-producing formation and the inner diameter of the tubing string, wherein the piston is configured to cause the container to open and to cause the dissolving material to exit the container in response to pressure being communicated to the piston.

* * * * *

UNITED STATES PATENT AND TRADEMARK OFFICE

CERTIFICATE OF CORRECTION

PATENT NO. : 8,776,885 B2
APPLICATION NO. : 13/820879
DATED : July 15, 2014
INVENTOR(S) : Luke W. Holderman It is certified that error appears in the above-identified patent and that said Letters Patent is hereby corrected as shown below:

On the title page, item (57), in column 2, in "Abstract", line 2, delete "a sand" and insert -- to a sand --, therefor.

In the Specification

In column 7, line 28, delete "mater" and insert -- matter --, therefor.

Signed and Sealed this
Second Day of December, 2014

Michelle K. Lee

Michelle K. Lee
*Deputy Director of the United States Patent and Trademark Office*